US010038292B2

(12) United States Patent
Matsuoka et al.

(10) Patent No.: US 10,038,292 B2
(45) Date of Patent: Jul. 31, 2018

(54) METHOD FOR CONNECTING INSULATED WIRES

(71) Applicant: Yazaki Corporation, Minato-ku, Tokyo (JP)

(72) Inventors: Syogo Matsuoka, Makinohara (JP); Sanae Katou, Makinohara (JP); Ayako Shimizu, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 229 days.

(21) Appl. No.: 14/843,040

(22) Filed: Sep. 2, 2015

(65) Prior Publication Data

US 2016/0064885 A1 Mar. 3, 2016

(30) Foreign Application Priority Data

Sep. 3, 2014 (JP) ..... 2014-178805
Sep. 3, 2014 (JP) ..... 2014-178806

(51) Int. Cl.
*H01R 43/02* (2006.01)
*H01R 4/18* (2006.01)
(Continued)

(52) U.S. Cl.
CPC ..... *H01R 43/0207* (2013.01); *H01R 4/183* (2013.01); *H01R 4/187* (2013.01);
(Continued)

(58) Field of Classification Search
CPC ..... H01R 43/048; H01R 4/187; H01R 4/62; H01R 43/0207; H01R 43/02; H01R 13/02;
(Continued)

(56) References Cited

U.S. PATENT DOCUMENTS 8,288,653 B2 * 10/2012 Stroh ..... H01R 4/021 174/74 R
9,281,574 B2 * 3/2016 Kawamura ..... H01R 4/183
(Continued)

FOREIGN PATENT DOCUMENTS

CN 102870292 A 1/2013
CN 103299493 A 9/2013
(Continued)

OTHER PUBLICATIONS

Communication dated Aug. 23, 2016, issued by the Japanese Patent Office in counterpart Japanese application No. 2014-178805.
(Continued)

*Primary Examiner* — Thiem Phan
(74) *Attorney, Agent, or Firm* — Sughrue Mion, PLLC

(57) ABSTRACT

A method for connecting a plurality of insulated wires to each other is provided. Each of the insulated wires has a conductor portion and an insulating coating covering the conductor portion. The insulating coating is made of an insulating material. The method includes stripping the insulating coating of each of the insulated wires to expose the conductor portion such that the insulating coating is removed from a section of the insulated wire along a direction in which the insulated wire extends and at a location away from an end portion of the insulated wire, and connecting the conductor portions of the insulated wires. The connecting includes crimping a crimp joint terminal onto the exposed conductor portions to join the exposed conductor portions, and after the crimping, welding the conductor portions by applying pressure and electric current or ultrasonic vibration to the crimp joint terminal.

5 Claims, 11 Drawing Sheets

(51) Int. Cl.
*H01R 43/048* (2006.01)
*H01R 4/62* (2006.01)

(52) U.S. Cl.
CPC ..... *H01R 43/048* (2013.01); *H01R 4/625* (2013.01); *Y10T 29/49213* (2015.01)

(58) Field of Classification Search
CPC ..... H01R 4/18; H01R 4/029; H01R 4/625; Y10T 29/5193; Y10T 29/53226; Y10T 29/49174; Y10T 29/49192; Y10T 29/49213
USPC ..... 29/879, 860, 868, 874, 876, 882
See application file for complete search history.

(56) References Cited

U.S. PATENT DOCUMENTS

| | | | |
|---|---|---|---|
| 2009/0133927 | A1 | 5/2009 | Onuma |
| 2009/0218134 | A1 | 9/2009 | Stroh et al. |
| 2012/0298645 | A1 | 11/2012 | Kleespiess et al. |
| 2013/0293045 | A1 | 11/2013 | Kajita et al. |
| 2015/0064991 | A1 | 3/2015 | Kawamura et al. |
| 2016/0064885 | A1 | 3/2016 | Matsuoka et al. |

FOREIGN PATENT DOCUMENTS

| | | | |
|---|---|---|---|
| JP | 59-18370 | U | 2/1984 |
| JP | 6-267597 | A | 9/1994 |
| JP | 6-267598 | A | 9/1994 |
| JP | 9-82375 | A | 3/1997 |
| JP | 2002-191109 | A | 7/2002 |
| JP | 2007-134307 | A | 5/2007 |
| JP | 2008-187814 | A | 8/2008 |
| JP | 2009-129812 | A | 6/2009 |
| JP | 2010-61870 | A | 3/2010 |
| JP | 2014-143205 | A | 8/2014 |
| JP | 2016-54037 | A | 4/2016 |

OTHER PUBLICATIONS

Communication dated Jun. 30, 2017, from the State Intellectual Property Office of People's Republic of China in counterpart Application No. 201510556677.8.
Office Action dated May 19, 2017 by the Japanese Patent Office in counterpart Japanese Patent Application No. 2016-183761.
Communication dated Feb. 23, 2018, from the State Intellectual Property Office of People's Republic of China in counterpart Application No. 201510556677.8.

* cited by examiner

METHOD FOR CONNECTING INSULATED WIRES

CROSS-REFERENCE TO RELATED APPLICATIONS

The present application claims priority from Japanese Patent Application Nos. 2014-178805 and 2014-178806 both filed on Sep. 3, 2014, the entire contents of which are incorporated herein by reference.

FIELD OF INVENTION

The present invention relates to a method for connecting conductor portions of insulated wires, each having an insulating coating made of an insulating material and covering the conductor portion.

RELATED ART

When forming an electric circuit of an automobile using a wire harness, multiple branching points are provided along insulated wires of the wire harness. At such a branching point on the insulated wires, insulating coatings of a plurality of insulated wires are removed to expose their conductor portions, and the exposed conductor portions are connected to each other.

Related art methods for connecting insulated wires include a "crimping joint" using a crimp joint terminal for a joint portion (see, e.g., JP2009-129812A), and a "welding joint" applying pressure and electric current or ultrasonic vibration to a joint portion (see, e.g., JP9-82375A).

According to the crimping joint, a plurality of insulated wires are connected to each other by crimping a crimp joint terminal onto conductor portions of the insulated wires where a joint portion is to be formed. Accordingly, it is easy to determine whether the connection is in a good condition from the external appearance of the crimp joint terminal that has been crimped. That is, it is possible to determine whether the joint portion of the insulated wires is firmly fixed from the external appearance of the crimp joint terminal. As a result, reliable mechanical connection can be obtained.

According to the welding joint, even when connecting a number of conductor portions of insulated wires to each other, heat or ultrasonic vibration required for the connection can be applied to an inner part of a joint portion, and contact resistance in the joint portion can be suppressed. As a result, reliable electric connection can be obtained.

However, as for the crimping joint, when the number of insulated wires to be connected increases, influence of irregularity such as looseness of conductor portions of the insulated wires becomes large so that connection among the conductor portions cannot be made to be in a good condition in an inner part of the joint portion, resulting in increased contact resistance. Accordingly, with the crimping joint, only a relatively small number of insulated wires can be connected. That is, when connecting a number of insulated wires by the crimping joint, there may arise a problem in reliability of electric connection. On the other hand, as for the welding joint, it is difficult to determine whether a joint portion of insulated wires is firmly fixed from its external appearance, so that there may arise a problem in reliability of mechanical connection.

In recent years, from the viewpoint of environmental consideration, it is an important issue in the automobile industry to improve fuel efficiency by weight reduction of a vehicle. To this end, there is an increasing interest in aluminum electric wires having conductor portions made of aluminum or aluminum alloy, which is lighter in weight than copper or copper alloy used as conductor portions of copper electric wires.

Thus, it is possible that aluminum electric wires and copper electric wires are be mixedly used in a wire harness. In such a case, at a branching point of insulated wires, a conductor portion made of aluminum or aluminum alloy (hereinafter, "aluminum conductor portion") and a conductor portion made of copper or copper alloy (hereinafter, "copper conductor portion") may be connected to each other.

On aluminum conductor portions, an oxide film is formed. Therefore, a crimp joint terminal may be formed with serrations or a through hole, providing a similar function as the serrations with a simple configuration, so as to break the oxide film by the serrations or the through hole at the time of crimping the crimp joint terminal to reduce contact resistance.

When a copper conductor portion and an aluminum conductor portion are mixedly joined and a through hole, providing a similar function as serrations with a simple configuration, is formed in a crimp joint terminal, it is difficult to place the aluminum conductor portion on the through hole due to irregularity such as looseness of the copper conductor portion and the aluminum conductor portion. Thus, the oxide film of the aluminum conductor portion may not be broken by the through hole, and as a result, reliability of electric connection is lowered.

SUMMARY

Illustrative aspects of the present invention provide a method for connecting insulated wires which can provide reliable electric and mechanical connection at a joint portion of the insulated wire, even when connecting a large number of insulated wires.

According to an illustrative aspect of the present invention, a method for connecting a plurality of insulated wires to each other is provided. Each of the insulated wires has a conductor portion and an insulating coating covering the conductor portion. The insulating coating is made of an insulating material. The method includes stripping the insulating coating of each of the insulated wires to expose the conductor portion such that the insulating coating is removed from a section of the insulated wire along a direction in which the insulated wire extends and at a location away from an end portion of the insulated wire, and connecting the conductor portions of the insulated wires. The connecting includes crimping a crimp joint terminal onto the exposed conductor portions to join the exposed conductor portions, and after the crimping, welding the conductor portions by applying pressure and electric current or ultrasonic vibration to the crimp joint terminal.

The stripping may include adjusting the sections of the insulated wires, from which the insulated coatings are removed, to be substantially equal to each other in the direction in which the insulated wires extend. The connecting the conductor portions may include aligning the sections of the insulated wires, from which the insulating coatings are removed, at both ends of the respective sections.

The insulated wires may include an aluminum electric wire and a copper electric wire. The conductor portion of the aluminum electric wire is made of aluminum or aluminum alloy. The conductor portion of the copper electric wire is made of copper or copper alloy. The connecting the conductor portions may include laying the conductor portion of the aluminum electric wire over at least a portion of a through hole formed in the crimp joint terminal.

The through hole may be formed in a portion of the crimp joint terminal forming a bottom portion of the crimp joint terminal after the crimping.

DETAILED DESCRIPTION

An exemplary embodiment of the invention will be described below in detail with reference to the drawings.

Figure 1:
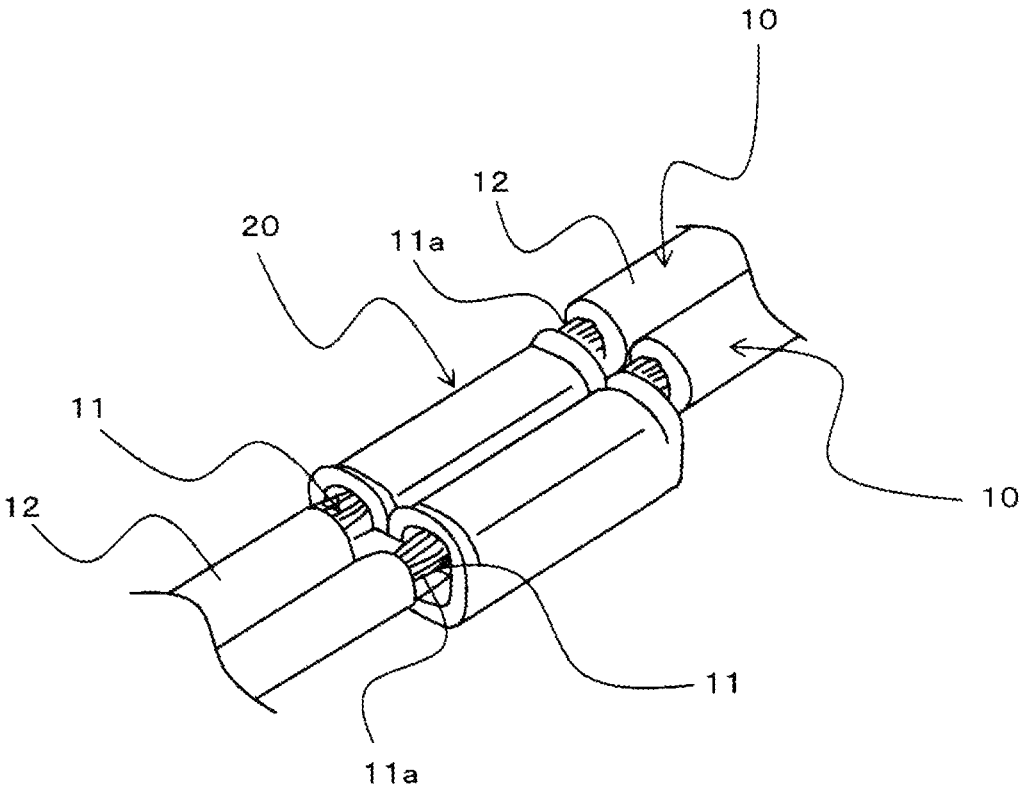
FIG. 1 is a perspective view of a periphery of a joint portion of two insulated wires connected by a method according to an exemplary embodiment of the present invention.

FIG. 1 is a perspective view illustrating the periphery of a joint portion 30 of two insulated wires 10 joined by a method according to the exemplary embodiment of the invention. The method according to the exemplary embodiment of the invention is used for a branching point of insulated wires of a wire harness forming an electric circuit for an automobile.

Each insulated wire 10 has a conductor portion 11, and an insulating coating 12 as an insulating material with which the outer circumference of the conductor portion 11 is coated. The conductor portion 11 includes a bundle of a plurality of strands 11*a* made of a conductive wire material such as copper or copper alloy. The conductor portion 11 is not limited to a bundle of a plurality of strands 11*a*, but may be a single core wire. The insulating coating 12 is made of insulating synthetic resin, and covers the conductor portion 11 to surround the outer circumference of the conductor portion 11 so as to protect the conductor portion 11 in an insulating manner from the outside.

In each of the two insulated wires 10, the insulating coating 12 is removed from a section of the insulated wire 10 along a direction in which the insulated wire 10 extends and at a location away from an end portion of the insulated wire 10 (hereinafter referred to as "intermediately-stripping the insulating coating is").

Next, a crimp joint terminal 20 for use in the method according to the exemplary embodiment of the invention will be described. The crimp joint terminal 20 crimps the exposed conductor portions 11 of the two insulated wires 10 to join the conductor portions 11 to each other. The crimp joint terminal 20 is formed by die press work or the like out of a plate-like member made of metal such as copper or copper alloy.

The crimp joint terminal 20 has a substantially U-shape in its cross section perpendicular to the extending direction of the insulated wires 10 mounted thereon. The U-shape has an opening on its top. Thus, the exposed conductor portions 11 of the two insulated wires 10 can be mounted on the crimp joint terminal 20 before the crimp joint terminal 20 is crimped to the exposed conductor portions 11 of the insulated wires 10. When the crimp joint terminal 20 is crimped to the conductor portions 11, the conductor portions 11 of the two insulated wires 10 are mounted on the approximately U-shaped crimp joint terminal 20 that has not been crimped yet, and the crimp joint terminal 20 is then crimped to surround the conductor portions 11 of the two insulated wires 10 by means of a not-shown crimping jig such as a so-called crimper or a so-called anvil.

Figure 2A:
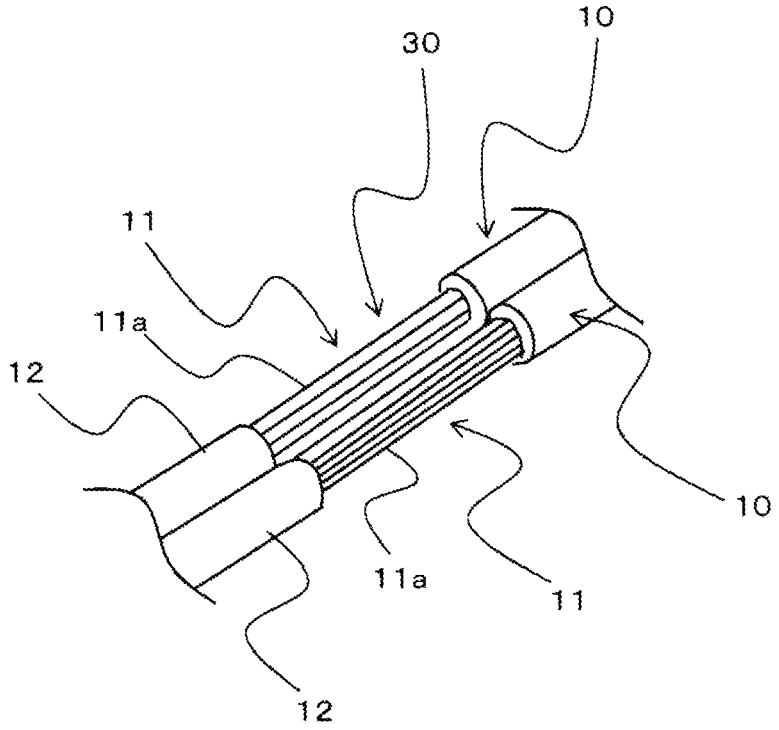
FIG. 2A is a view of the two insulated wires with conductor portions exposed by intermediately-stripping insulating coatings arranged next to each other.
Figure 2B:
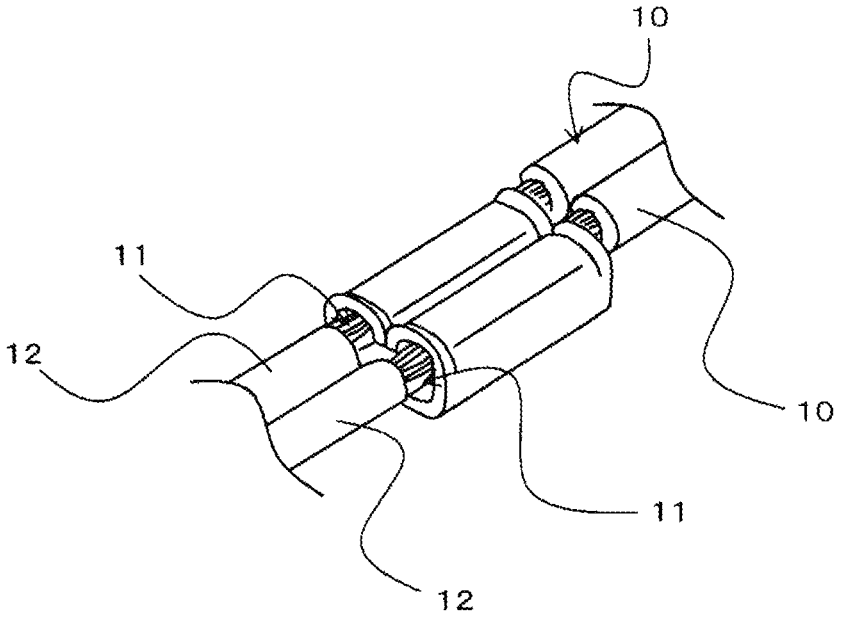
FIG. 2B is a view illustrating a state in which the exposed conductor portions of the two insulated wires are joined by crimping joint.

Next, a work process in the method for connecting insulated wires will be described with reference to FIG. 2A to FIG. 3B. FIG. 2A is a view illustrating the two insulated wires 10 disposed so that the conductor portions 11 exposed by intermediately-stripping the insulating coatings 12 can be arranged in parallel. FIG. 2B is a view illustrating a state in which the exposed conductor portions 11 of the two insulated wires 10 have been crimped and joined to each other.

Figure 3A:
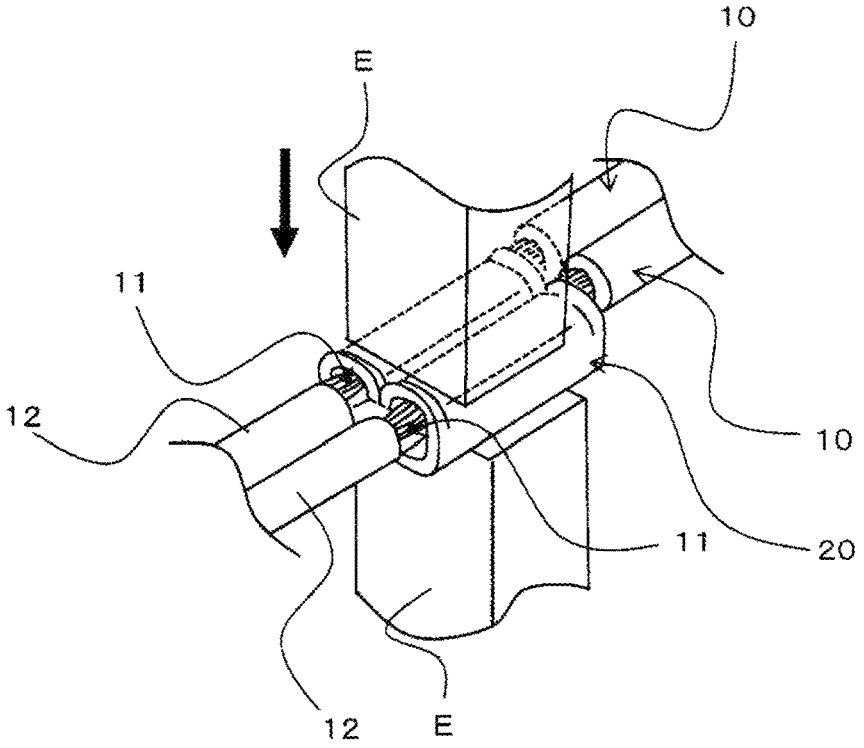
FIG. 3A is a view illustrating a state in which electrodes are pressed against a crimp joint terminal for welding joint.
Figure 3B:
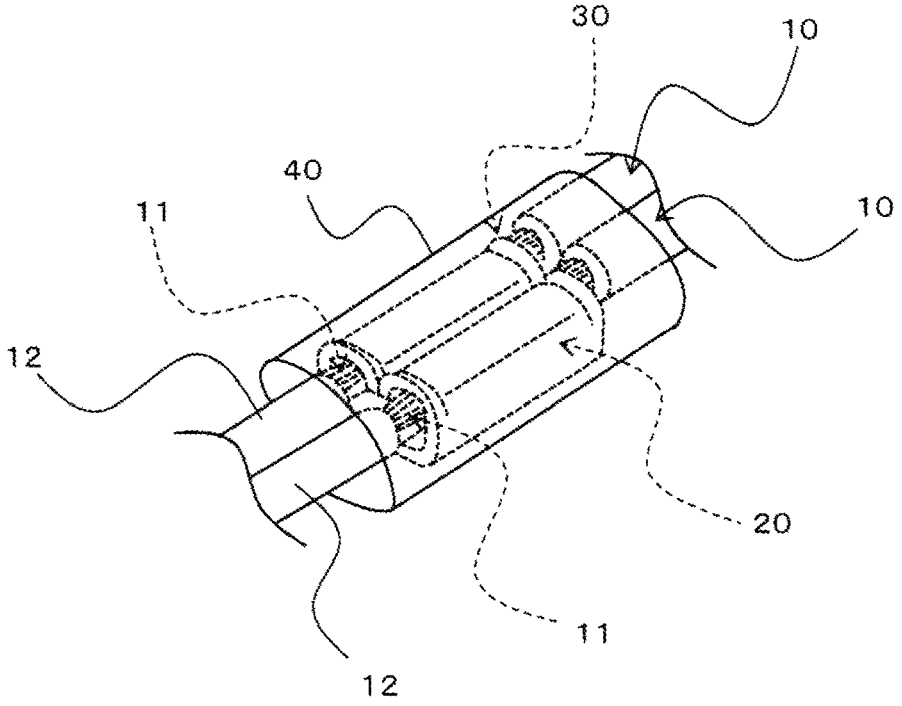
FIG. 3B is a view illustrating a state in which the joint portion of the two insulated wires including the crimp joint terminal after the welding joint are covered by an insulating tape.

FIG. 3A is a view illustrating a state in which electrodes E have been pressed against the crimp joint terminal 20 for welding joint. FIG. 3B is a view illustrating a state in which the joint portion 30 of the two insulated wires 10 including the crimp joint terminal 20 after the welding joint has been covered with an insulating tape 40. The work that will be described below may be performed automatically using an apparatus or may be performed manually using a jig or the like.

First, an insulating coating intermediately-stripping step is carried out (see FIG. 2A). The insulating coating intermediately-stripping step is a step of stripping the insulating coating 12 of each insulated wire 10 at its intermediate portion to expose the conductor portion 11 of the insulated wire 10. When the insulating coating 12 of the insulated wire 10 is thus intermediately-stripped to expose the conductor portion 11, the conductor portion 11 can be kept in an ordered state without looseness or the like, as compared with the case where the insulating coating 12 in a terminal portion of the coating electric wire 10 is stripped to expose the conductor portion 11. Thus, the conductor portions 11 of the two insulated wires 10 can be crimped and joined to each other easily. In addition, when the conductor portions 11 of the two insulated wires 10 exposed by intermediately-stripping the insulating coatings 12 are joined to each other in this manner, the joint portion 30 of the insulated wires 10 has the same number of branches as in the case where four insulated wires 10 branch therefrom. Therefore, in order to form branches of an even number of insulated wires 10 in the joint portion 30, the number of the used insulated wires 10 can be suppressed when the conductor portions 11 of the coating electric wires 10 exposed by intermediate-stripping are connected to each other, as compared with the case where conductor portions of terminal portions of insulated wires are exposed and joined. In order to form branches of an odd number of insulated wires 10 in the joint portion 30, it will go well if a branch electric wire that will be not used is processed as a dummy electric wire. In the insulating coating intermediately-stripping step, the sections of the two insulated wires 10, from which the insulating coatings 12 are removed, are adjusted to be substantially equal to each other in the direction in which the insulated wires extend.

After that, in a conductor portion connecting step, the crimp joint terminal 20 is crimped onto the exposed conductor portions 11 of the two insulated wires 10 to join the conductor portions 11 (see FIG. 2B). The crimp joint terminal 20 is crimped by means of a not-shown crimping jig such as a crimper or an anvil.

After that, in the conductor portion connecting step, electrodes E, which are generally used for welding joint, are pressed against the crimp joint terminal 20, and pressure and electric current are applied to the crimp joint terminal 20 from the electrodes 20, so as to weld and join the conductor portions 11 of the two insulated wires 10 (see FIG. 3A). Thus, the connection at the joint portion 30 of the two insulated wires 10 is provided by using both the crimping joint and the welding joint. In the conductor portion connecting step, the two insulated wires 10 are connected in a state in which the sections of the insulated wires 10 from which the insulating coatings 12 are removed are aligned with each other at both ends of the respective sections.

After that, the joint portion 30 including the crimp joint terminal 20 after the welding joint is covered with the insulating tape 40 (see FIG. 3B). Due to this work, the joint portion 30 of the two insulated wires 10 is protected in an insulating manner.

Figure 4:
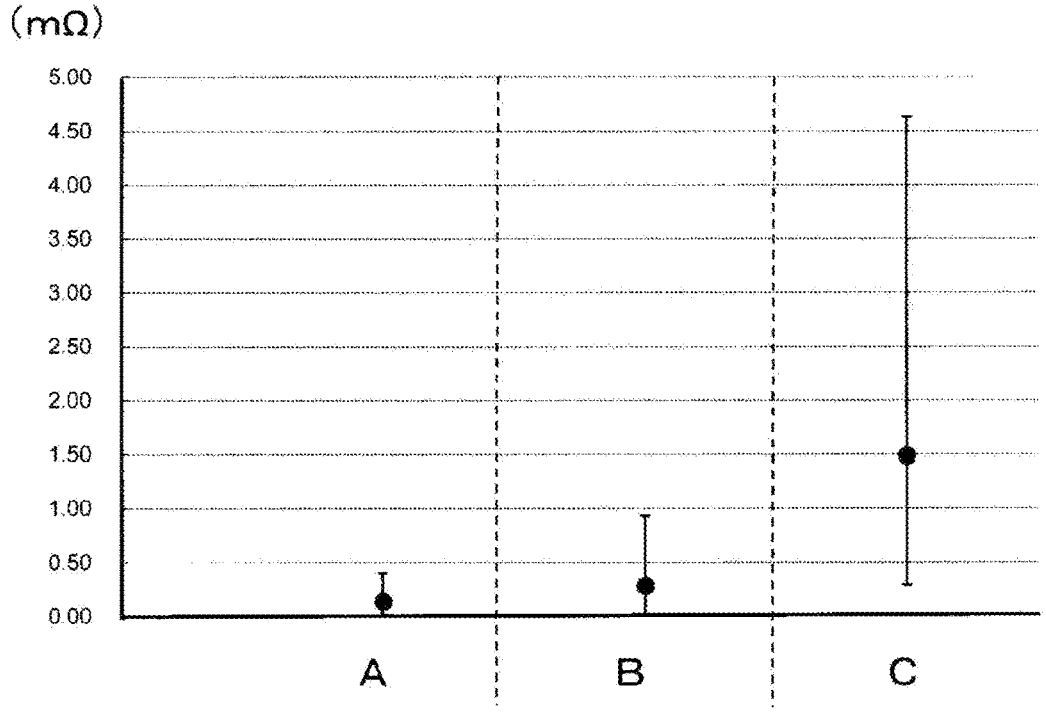
FIG. 4 is a graph showing contact resistances after durability tests for a case in which eight insulated wires were joined without welding joint after the crimping joint and a case in which eight insulated wires were joined with welding joint after the crimping joint.
Figure 5:
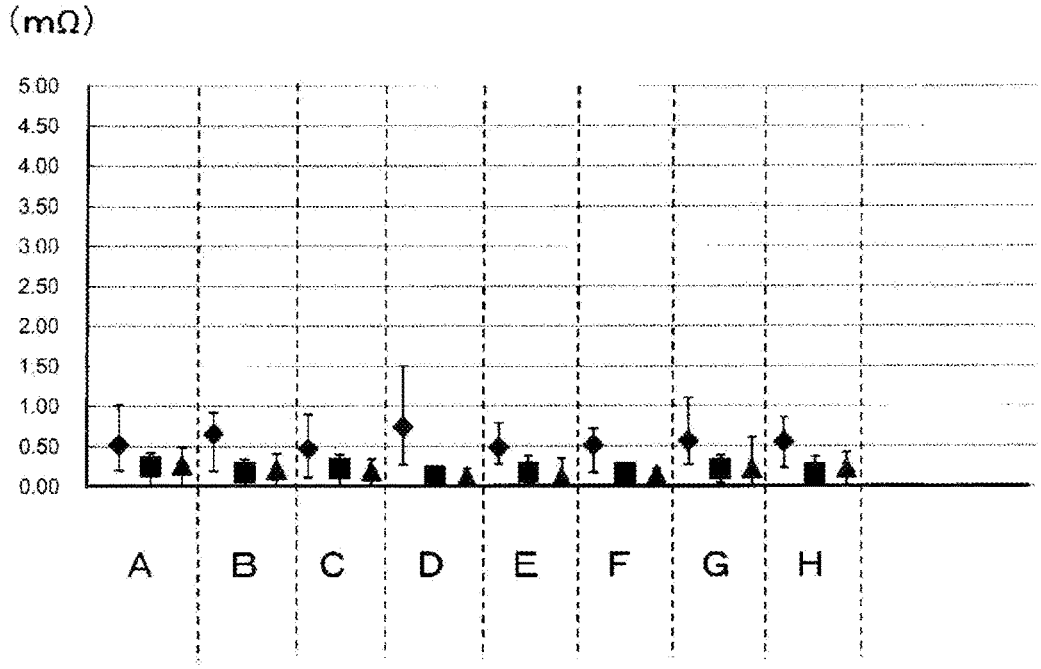
FIG. 5 is a graph showing contact resistances after crimping joint, after welding joint and after durability tests, in which the material of a crimp joint terminal and the number of insulated wires to be joined were changed.

Next, contact resistances in the joint portion 30 after crimping joint and after welding joint further performed after the crimping joint will be compared with each other with reference to FIG. 4 and FIG. 5. Graphs shown in FIG. 4 and FIG. 5 show results of tests performed for confirming the advantage of the invention. In each durability test, thermal treatment at 120° C. for 120 hours was performed on the joint portion 30 of the insulated wires 10, and contact resistance was evaluated.

FIG. 4 is a graph showing contact resistances after durability tests for a case in which eight insulated wires 10 were joined without welding joint after crimping joint and a case in which eight insulated wires were joined with welding joint after crimping joint. FIG. 4 also shows contact resistance for a case in which six insulated wires 10 were joined with welding joint after crimping joint. In addition, in FIG. 4, the ordinate designates contact resistance (mΩ), and measurement data under three joining conditions A to C are arranged and shown along the abscissa. In addition, in the joining condition A, the number of insulated wires 10 to be joined was six, and welding joint was performed after crimping joint. In the joining condition B, the number of insulated wires 10 to be joined was eight, and welding joint was performed after crimping joint. In the joining condition C, the number of insulated wires 10 to be joined was eight, and welding joint was not performed after crimping joint.

FIG. 5 is a graph showing contact resistances after crimping joint, after welding joint and after a durability test, in which the material of the crimp joint terminal 20 and the number of insulated wires 10 to be joined were changed. In addition, in FIG. 5, the ordinate designates contact resistance (mΩ), and measurement data under eight joining conditions A to H are arranged and shown along the abscissa. In each condition, measurement data after crimping joint, measurement data after welding joint further performed after the crimping joint, and measurement data after a durability test performed after the welding joint are arranged and shown respectively from the left to the right while different symbols are given to mean values of those measurement data respectively. In the joining condition A in FIG. 5, the material of the crimp joint terminal was iron, the surface of which was plated with tin, and the number of insulated wires 10 to be joined was five. In the joining condition B in FIG. 5, the material of the crimp joint terminal was an alloy of copper and tin, the surface of which was plated with tin, and the number of insulated wires 10 to be joined was five. In the joining condition C in FIG. 5, the material of the crimp joint terminal was iron, the surface of which was plated with tin, and the number of insulated wires 10 to be joined was six. In the joining condition D in FIG. 5, the material of the crimp joint terminal was an alloy of copper and tin, the surface of which was plated with tin, and the number of insulated wires 10 to be joined was six. In the joining condition E in FIG. 5, the material of the crimp joint terminal was iron, the surface of which was not plated with anything, and the number of insulated wires 10 to be joined was five. In the joining condition F in FIG. 5, the material of the crimp joint terminal was an alloy of copper and tin, the surface of which was not plated with anything, and the number of insulated wires 10 to be joined was five. In the joining condition G in FIG. 5, the material of the crimp joint terminal was iron, the surface of which was not plated with anything, and the number of insulated wires 10 to be joined was six. In the joining condition H in FIG. 5, the material of the crimp joint terminal was an alloy of copper and tin, the surface of which was not plated with anything, and the number of insulated wires 10 to be joined was six.

From the graph shown in FIG. 4, it is understood that contact resistance in the case where welding joint was performed after crimping joint was suppressed to be lower than in the case where welding joint was not performed after crimping joint. In addition, when the joining conditions A and B are compared, it is understood that contact resistance could be suppressed to be low even if the number of insulated wires 10 to be joined was increased.

From the graph shown in FIG. 5, contact resistance after crimping joint increased in some cases, but it is understood that the contact resistance after welding joint was further performed after the crimping joint could be suppressed to be low regardless of the difference among the joining conditions A to H. It is also understood that the contact resistance after a durability test was performed after the welding joint further performed after the crimping joint could be suppressed to be low regardless of the difference among the joining conditions A to H. That is, it is understood that, when welding joint is performed after crimping joint, contact resistance can be suppressed to be low for each number of insulated wires 10 to be joined and for various materials of the crimp joint terminal 20.

In the method according to the exemplary embodiment, an exposed part of each conductor portion 11 is covered with the insulating coating 12 in its opposite end portions in its extending direction. Accordingly, irregularity such as looseness hardly occurs. Thus, conductor portions 11 of a plurality of insulated wires 10 can be crimped and connected to each other easily. Further, by performing the welding joint after the crimping joint, reliable electric connection of conductor portions of a large number of insulated wires 10 can be ensured by the welding joint in addition to reliable mechanical connection ensured by the crimping joint. Accordingly, reliable electric and mechanical connection can be ensured at the joint portion 30 of the insulated wires 10, even when connecting a large number of insulated wires 10.

In addition, in the method according to the exemplary embodiment, the sections of the insulated wires 10 along which the conductor portions 11 are exposed are substantially equal to each other. Accordingly, by connecting the conductor portions 11 of the insulated wires 10 such that the sections along which the conductor portions 11 are exposed are aligned with each other at both ends of the respective sections, a portion to be insulated and protected can be provided to fit within a given area easily. As a result, the joint portion can be insulated and protected easily by the insulating tape 40 or the like.

In the method according to the exemplary embodiment, two insulated wires 10 are joined. However, the number of insulated wires 10 to be joined is not limited to two.

Another exemplary embodiment of the invention will be described below in detail with reference to FIG. 6A to FIG. 12B.

Figure 6A:
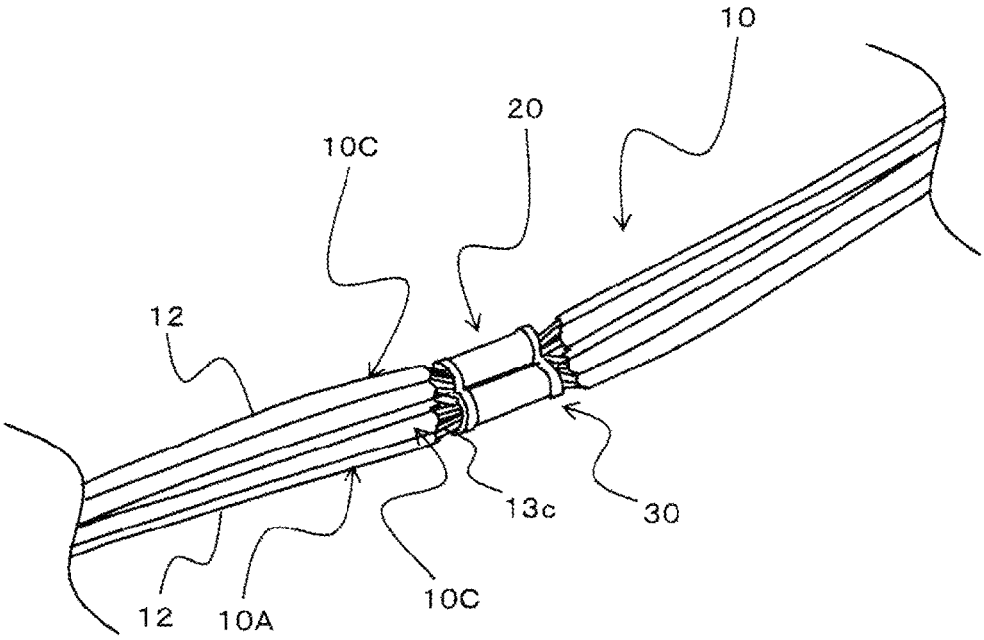
FIG. 6A and FIG. 6B are perspective views of a periphery of a joint portion of a plurality of insulated wires joined by a method according to another exemplary embodiment of the present invention, FIG. 6A being a view in which a crimp joint terminal is observed from the crimping side, and FIG. 6B being a view in which the crimp joint terminal is observed from the through hole side.
Figure 6B:
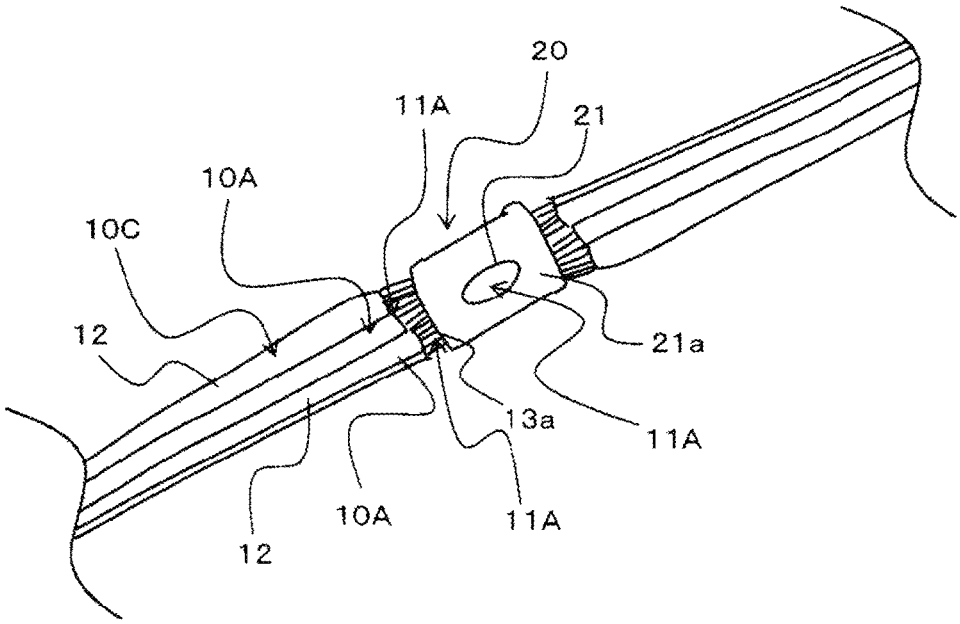
Figure 7:
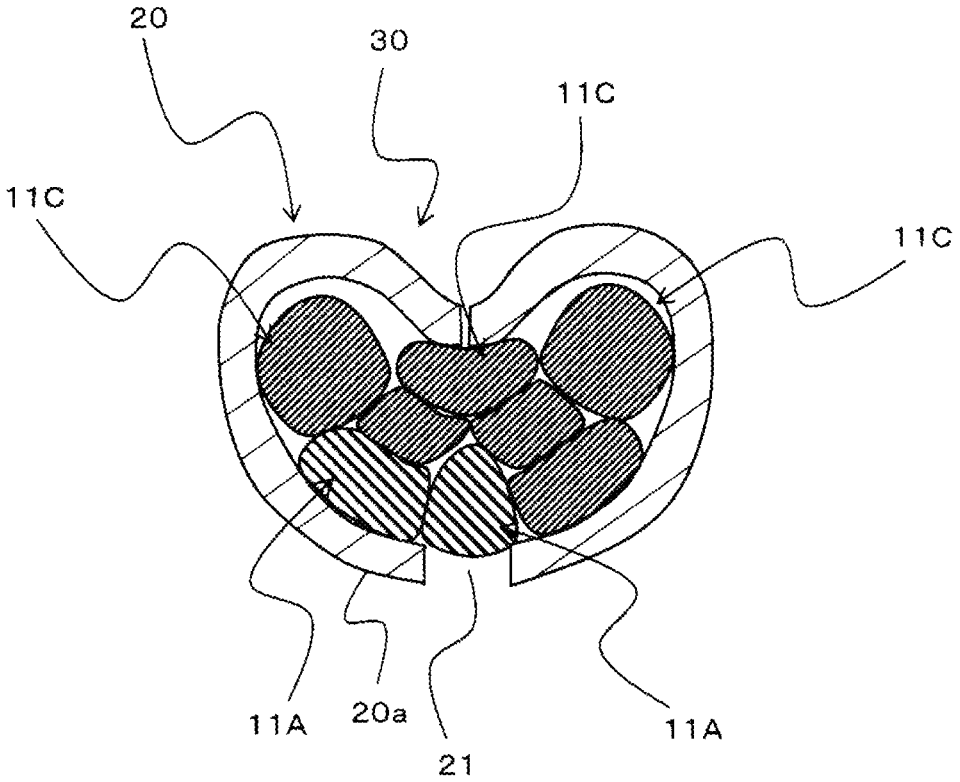
FIG. 7 is a sectional view of the joint portion shown in FIG. 6A and FIG. 6B.

FIG. 6A and FIG. 6B are perspective views of a periphery of a joint portion 30 of a plurality of insulated wires 10 connected by a method according to another exemplary embodiment of the present invention. FIG. 6A is a view in which a crimp joint terminal 20 is observed from the crimping side, and FIG. 6B is a view in which the crimp joint terminal 20 is observed from the through hole 21 side. FIG. 7 is a sectional view of the joint portion 30. In FIG. 7, copper conductor portions 11C and aluminum conductor portions 11A are simplified and depicted without showing their copper strands 13*c* and aluminum strands 13 respectively. The method according to this exemplary embodiment is for connecting conductor portions 11 of the insulated wires 10 that include two kinds of insulated wires 10, that is aluminum electric wires 10A each having an aluminum conductor portion 11A made of aluminum or aluminum alloy and an insulating coating 12 covering the aluminum conductor portion 11A, and copper electric wires 10C each having a copper conductor portion 11C made of copper or copper alloy and an insulating coating 12 covering the copper conductor portion 11C.

Each copper electric wire 10C has a copper conductor portion 11C, and an insulating coating 12 as an insulating material with which the outer circumference of the copper conductor portion 11C is coated. The copper conductor portion 11C is a bundle of a plurality of copper strands 13*c* made of a wire material such as copper or copper alloy. The copper conductor portion 11C is not limited to a bundle of a plurality of copper strands 13*c*, but may be a single core wire. The insulating coating 12 is made of insulating synthetic resin, which coats and surrounds the outer circumference of the copper conductor portion 11C so as to protect the copper conductor portion 11C in an insulating manner from the outside.

In each copper electric wire 10C, the insulating coating 12 is removed from a section of the copper electric wire 10C along a direction in which the copper electric wire 10C extends and at a location away from an end portion of the copper electric wire 10C (the insulating coating is intermediately-stripped).

Each aluminum electric wire 10A has an aluminum conductor portion 11A, and an insulating coating 12 as an insulating material with which the outer circumference of the aluminum conductor portion 11A is coated. The aluminum conductor portion 11A is a bundle of a plurality of aluminum strands 13*a* made of a wire material such as aluminum or aluminum alloy. The aluminum conductor portion 11A is not limited to a bundle of a plurality of aluminum strands 13*a*, but may be a single core wire. The insulating coating 12 is made of insulating synthetic resin, which coats and surrounds the outer circumference of the aluminum conductor portion 11A so as to protect the aluminum conductor portion 11A in an insulating manner from the outside.

Intermediate-stripping is performed on the aluminum electric wires 10A in the same manner as the copper electric wires 10C.

The crimp joint terminal 20 according to the exemplary embodiment has a through hole 21. The through hole 21 is formed in a portion of the crimp joint terminal 20 forming a bottom portion 20*a* of the crimp joint terminal 20 when the crimp joint terminal 20 is crimped. The through hole 21 serves as a so-called serration, and is configured to break an oxide film of the exposed aluminum conductor portion 11A of the aluminum electric wire 10A when the crimp joint terminal 20 is crimped. Considering the strength and the like of the crimp joint terminal 20, the area over which the through hole 21 is formed cannot be made so large, but the through hole 21 has a simple configuration as compared with serrations so that it is easy to form.

Figure 8A:
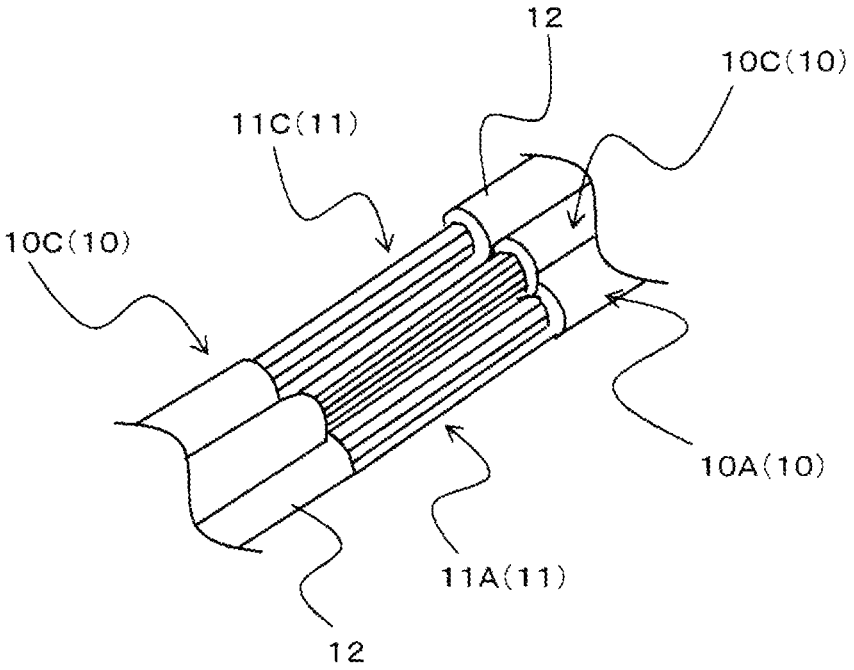
FIG. 8A is a view illustrating aluminum electric wires and copper electric wires in which insulating coatings have been intermediately-stripped to expose conductor portions.
Figure 8B:
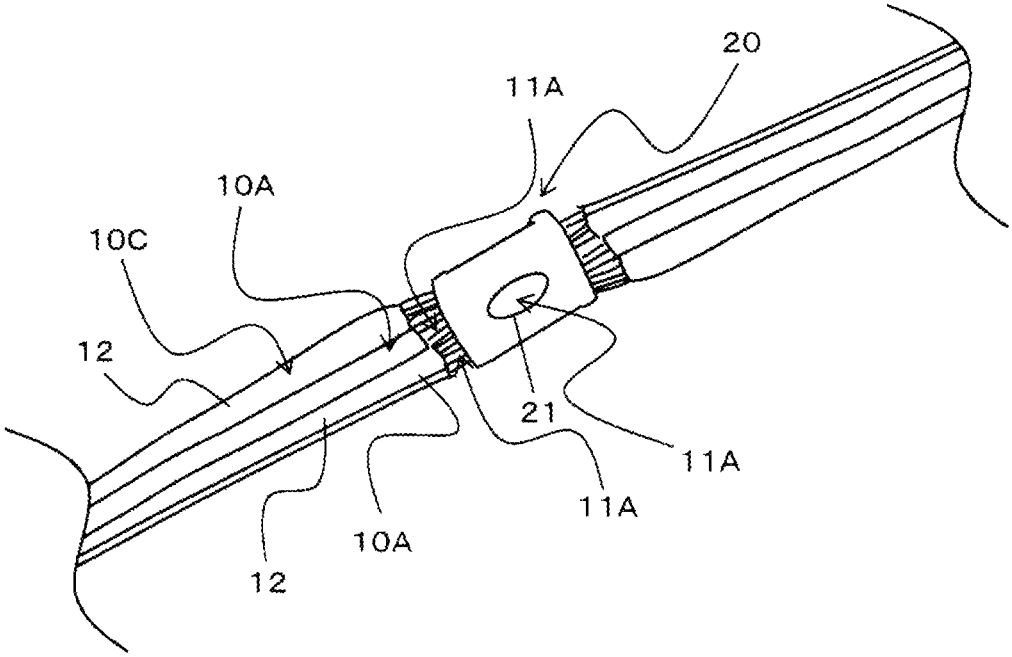
FIG. 8B is a view illustrating a state in which the exposed conductor portions of the plurality of aluminum electric wires and copper electric wires are joined by crimping joint.
Figure 9A:
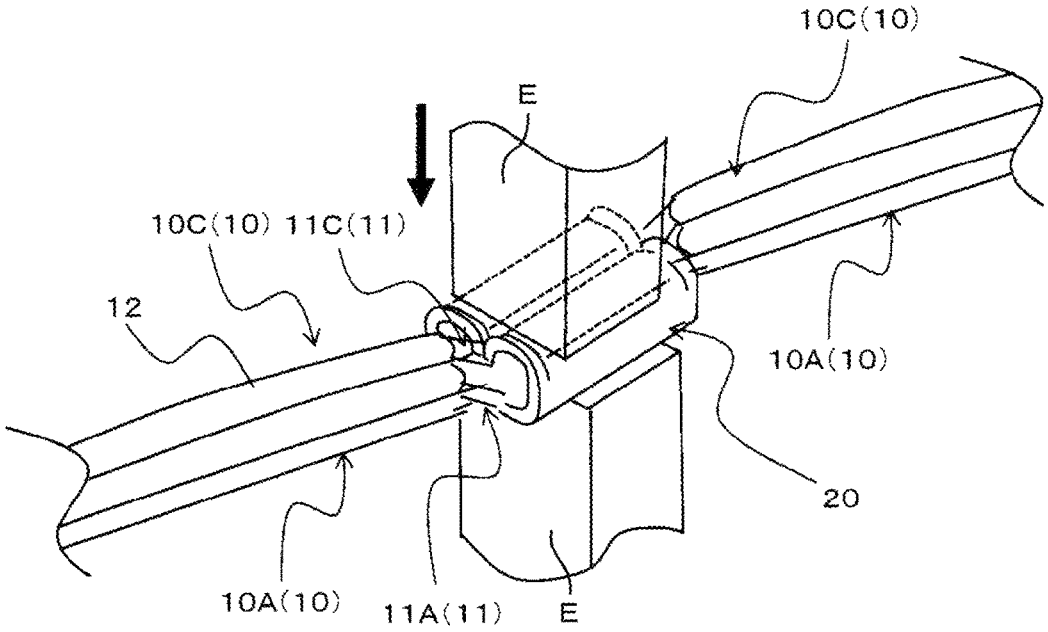
FIG. 9A is a view illustrating a state in which electrodes E have been pressed against a crimp joint terminal for welding joint.
Figure 9B:
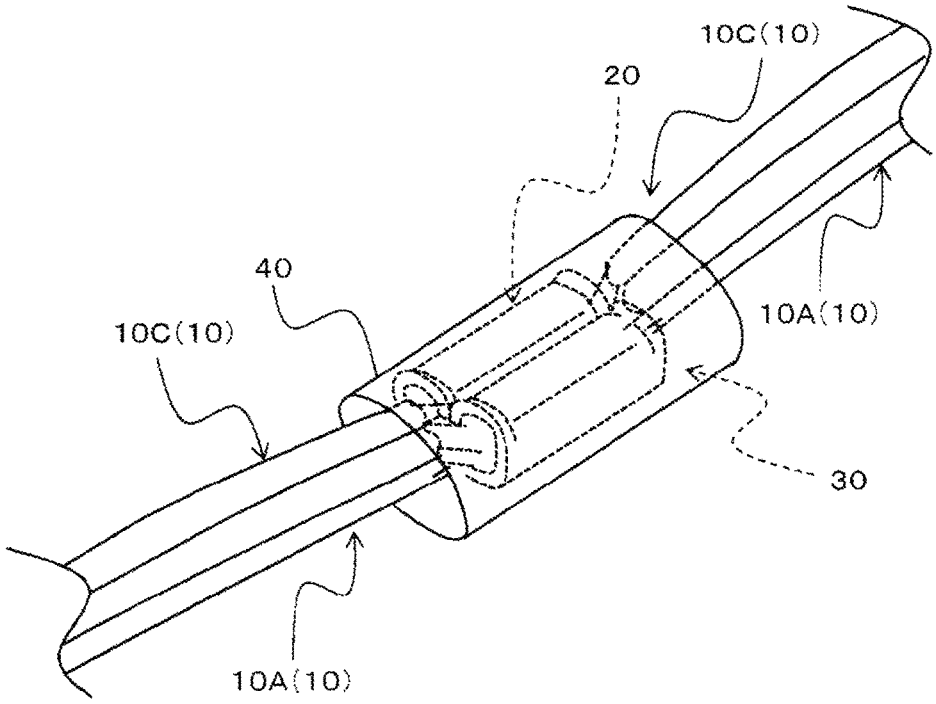
FIG. 9B is a view illustrating a state in which the joint portion including the crimp joint terminal after the welding joint has been covered with an insulating tape.

Next, a work process in the method for connecting insulated wires will be described with reference to FIG. 8A to FIG. 9B. FIG. 8A is a view illustrating aluminum electric wires 10A and copper electric wires 10B in which insulating coatings 12 have been intermediately-stripped to expose conductor portions 11. FIG. 8B is a view illustrating a state in which exposed conductor portions 11 of a plurality of electric wires 10 are joined by crimping joint. FIG. 9A is a view illustrating a state in which electrodes E are pressed against a crimp joint terminal for welding joint. FIG. 9B is a view illustrating a state in which a joint portion 30 including the crimp joint terminal 20 after the welding joint has been covered with an insulating tape 40. The work that will be described below may be performed automatically using an apparatus or may be performed manually using a jig or the like.

First, an insulating coating intermediately-stripping step is carried out (see FIG. 8A). The insulating coating intermediately-stripping step is a step of stripping insulating coatings 12 of a plurality of insulated wires 10 in their intermediate portions to expose conductor portions 11 of the insulated wires 10 respectively. Aluminum electric wires 10A and copper electric wires 10C are mixed in the insulated wires 10. When the insulating coatings 12 of the insulated wires 10 are thus intermediately-stripped to expose the conductor portions 11, aluminum conductor portions 11A and copper conductor portions 11C can be kept in an ordered state without looseness or the like, as compared with the case where the insulating coatings 12 in terminal portions of the coating electric wires 10 are stripped to expose the aluminum conductor portions 11A and the copper conductor portions 11C respectively.

In addition, when the conductor portions 11 of the insulated wires 10 exposed by intermediately-stripping the insulating coatings 12 are connected to each other in this manner, a larger number of branches can be obtained using a smaller number of insulated wires in the joint portion 30 of the insulated wires 10, as compared with the case where conductor portions exposed at terminal portions of insulated wires are joined. In order to form branches of an odd number of insulated wires 10 in the joint portion 30, it will go well if a branch electric wire that will not be used is processed as a dummy electric wire. In the insulating coating intermediately-stripping step, the sections of the insulated wires 10 from which the insulating coatings 12 are removed are adjusted to be substantially equal to each other in the direction in which the insulated wires 10 extend.

After that, in a conductor portion connecting step, the crimp joint terminal 20 is crimped onto two kinds of exposed conductor portions 11 of the plurality of insulated wires 10 including aluminum electric wires 10A and copper electric wires 10C to join the conductor portions 11 (see FIG. 8B). The crimp joint terminal 20 is crimped by means of a not-shown crimping jig such as a crimper or an anvil. In this step, the aluminum conductor portion 11A is laid over at least a portion of the through hole 21 formed in the crimp joint terminal 20, and two kinds of conductor portions 11 are joined by crimping the crimp joint terminal 20. Here, each of the aluminum conductor portions 11A and the copper conductor portions 11C exposed by intermediately-stripping the insulating coatings 12 can be prevented from irregularity such as looseness. Therefore, the aluminum conductor portion 11A can be easily laid over at least a portion of the through hole 21 (see FIG. 7). Thus, even when connecting the mixture of the aluminum conductor portions 11A and the copper conductor portions 11C, the oxide film of the aluminum conductor portion 11A can be reliably broken by the through hole 21 at the time of crimping joint.

After that, in the conductor portion connecting step, electrodes E, which are generally used for welding joint, are pressed against the crimp joint terminal 20, and pressure and electric current are applied to the crimp joint terminal 20 from the electrodes E, so as to weld and join the conductor portions 11 of the insulated wires 10 (see FIG. 9A). Thus, joining in the joint portion 30 of the insulated wires 10 is achieved using two joint methods, that is, crimping joint and welding joint. In the conductor portion connecting step, the insulated wires 10 are connected such that the sections from which the insulating coatings 12 are removed are aligned with each other at both ends of the respective sections.

After that, the joint portion 30 including the crimp joint terminal 20 after the welding joint is covered with the insulating tape 40 (see FIG. 9B). This makes the joint portion 30 of the insulated wires 10 protected in an insulating manner.

Figure 10A:
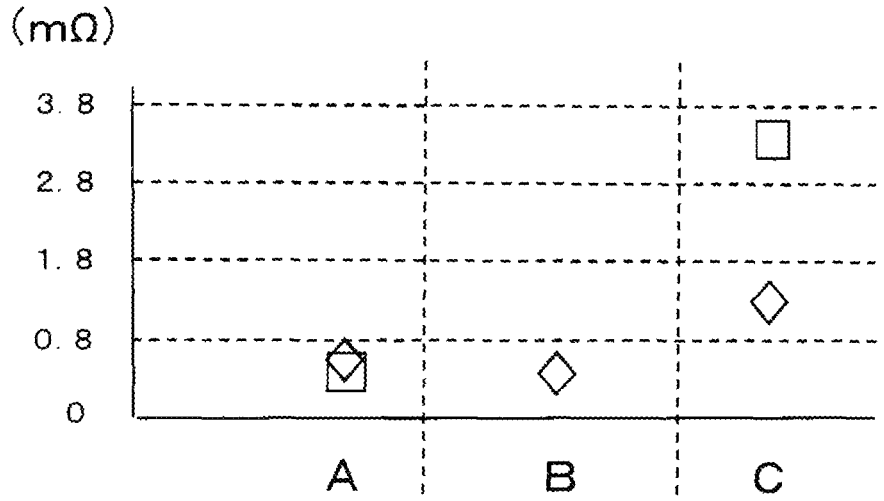
FIG. 10A and FIG. 10B are graphs for comparison of contact resistances in joint portions depending on a difference in disposed position of each aluminum conductor portion relative to a crimp joint terminal and a difference between presence and absence of welding joint after crimping joint.
Figure 10B:
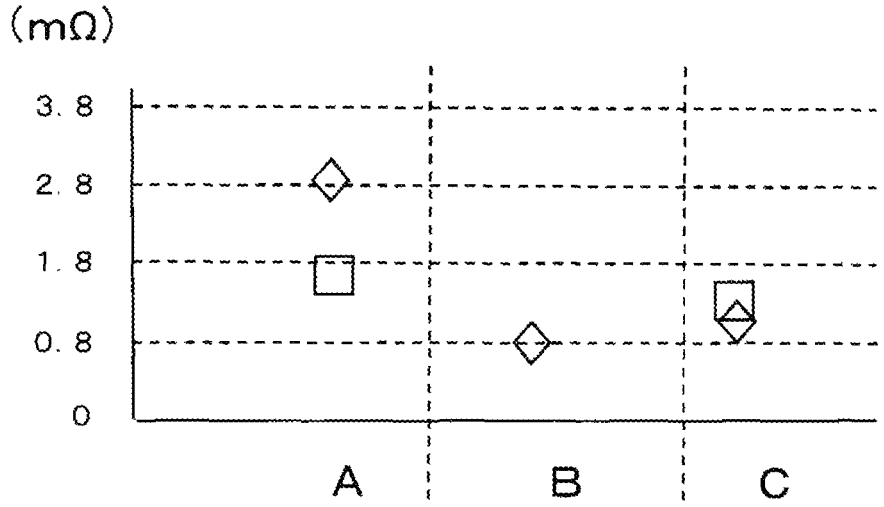
Figure 11A:
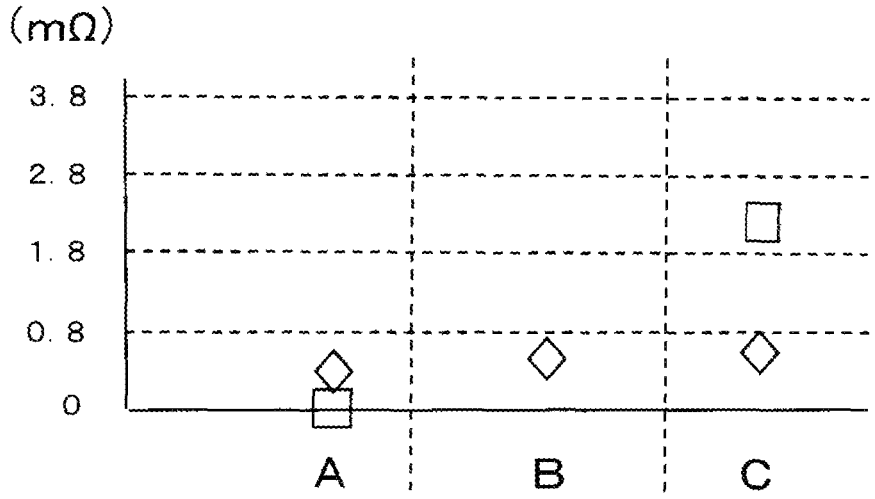
FIG. 11A and FIG. 11B are graphs for comparison of contact resistances in joint portions depending on a difference in disposed position of each aluminum conductor portion relative to a crimp joint terminal and a difference between presence and absence of welding joint after crimping joint.
Figure 11B:
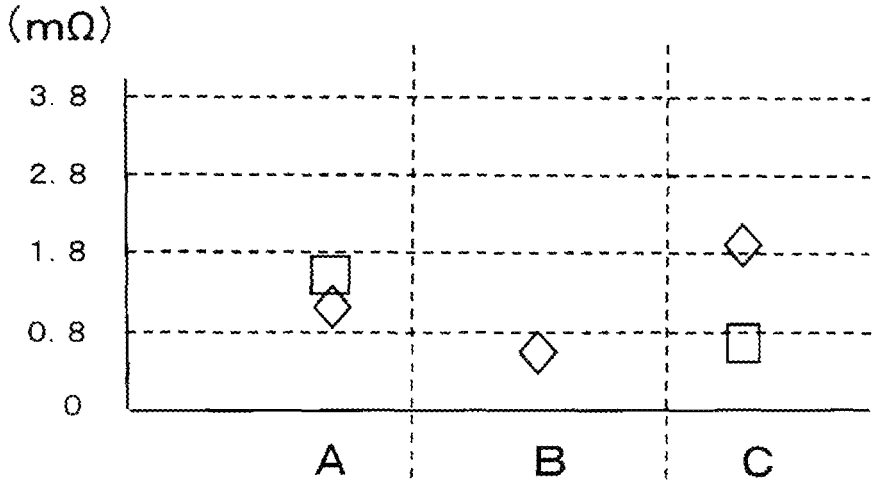
Figure 12A:
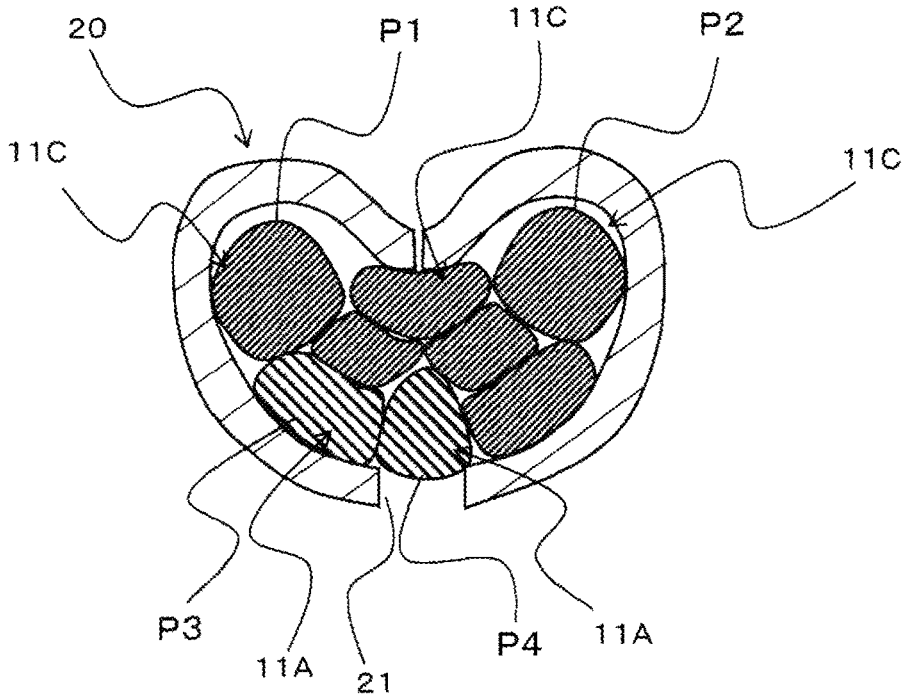
FIG. 12A is a view illustrating a relationship of arrangement of two kinds of insulated wires to a crimp joint terminal in a method according to the exemplary embodiment of the invention.
Figure 12B:
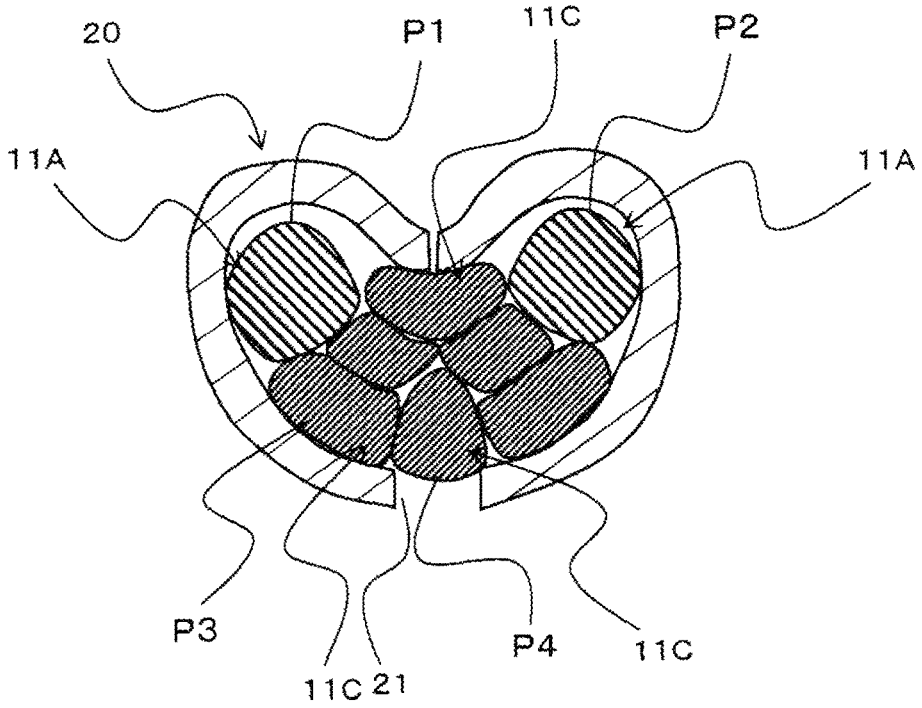
FIG. 12B is a view illustrating a relationship of arrangement to be compared with FIG. 12A.

Next, contact resistances in joint portions depending on a difference in disposed position of each aluminum conductor portion 11A relative to the crimp joint terminal 20 and a difference between presence and absence of welding joint after crimping joint will be compared with reference to FIG. 10A to FIG. 12B. FIG. 10A to FIG. 11B are graphs for comparison of contact resistances in joint portions 30 depending on a difference in disposed position of each aluminum conductor portion 11A relative to the crimp joint terminal 20 and a difference between presence and absence of welding joint after crimping joint. FIG. 12A is a view illustrating a relationship of arrangement of two kinds of insulated wires to a crimp joint terminal in the method according to the exemplary embodiment. FIG. 12B is a view illustrating a relationship of arrangement to be compared with FIG. 12A. The graphs shown in FIG. 10A to FIG. 11B show results of tests performed for confirming the advantage of the invention. In each durability test, thermal treatment at 120° C. for 138 hours was performed on the joint portion 30 of the insulated wires 10, and contact resistance was evaluated. In FIG. 10A to FIG. 11B, the ordinate designates contact resistance (me), and measurement data of contact resistance obtained after crimping joint (designated by the sign A), after welding joint was further performed after the crimping joint (designated by the sign B), and after the durability test was performed (designated by the sign C) are arranged and shown along the abscissa. In addition, in the graphs, "diamond mark" designates measurement data in which welding joint was performed after crimping joint, and "square mark" designates measurement data in which welding joint was not performed after crimping joint.

FIG. 10A shows results of measurement obtained as follows. That is, as shown in FIG. 12A, aluminum conductor portions 11A were disposed in a position P3 and a position P4, and copper conductor portions 11C were disposed in the other positions. Contact resistance between the aluminum conductor portions 11A disposed in the position P3 and the position P4 was measured. FIG. 10B shows results of measurement obtained as follows. That is, as shown in FIG. 12B, aluminum conductor portions 11A were disposed in a position P1 and a position P2, and copper conductor portions 11C were disposed in the other positions. Contact resistance between the aluminum conductor portions 11A disposed in the position P1 and the position P2 was measured.

FIG. 11A shows results of measurement obtained as follows. That is, aluminum conductor portions 11A were disposed in a position P3 and a position P4, and copper conductor portions 11C were disposed in the other positions (see FIG. 12A). Contact resistance between the aluminum conductor portion 11A disposed in the position P3 and the copper conductor portion 11C disposed in the position P1 was measured. FIG. 11B shows results of measurement obtained as follows. That is, aluminum conductor portions 11A were disposed in a position P1 and a position P2, and copper conductor portions 11C were disposed in the other positions (see FIG. 12B). Contact resistance between the aluminum conductor portion 11A disposed in the position P1 and the copper conductor portion 11C disposed in the position P3 was measured.

In the graphs shown in FIG. 10A to FIG. 11B, the measurement data with "diamond marks" on the abscissa signs B and C in the graphs of FIG. 10A and FIG. 11A correspond to the method according to the exemplary embodiment. It is understood that contact resistance in those measurement data is suppressed to be lower than that in the other joining conditions.

In the method according to the exemplary embodiment, the insulating coatings 12 of the aluminum electric wires 10A and the copper electric wires 10C are removed over predetermined sections in their extending directions and at locations away from their end portions of the aluminum electric wires 10A and the copper electric wires 10C respectively to thereby expose the aluminum conductor portions 11A and the copper conductor portions 11C. Accordingly, the aluminum conductor portions 11A and the copper conductor portions 11C can be prevented from irregularity such as looseness. Thus, when crimping the crimp joint terminal 20 onto the conductor portions 11 of the insulated wires 10 including two kinds of insulated wires 10, that is, the aluminum electric wires 10A and the copper electric wires 10C, to join the conductor portions 11, the aluminum conductor portion 11A can be easily laid over the through hole 21 that functions in a similar manner as serrations but with a simple configuration. Therefore, the oxide film of each aluminum conductor portion 11A can be reliably broken by the through hole 21. In addition, welding joint is further performed after crimping joint. Accordingly, reliable electric and mechanical connection can be ensured at the joint portion 30 of the insulated wires 10, even when connecting a large number of insulated wires 10 including the aluminum electric wires 10A and the copper electric wires 10C with a simple configuration.

In addition, in the method according to the exemplary embodiment, when crimping joint is performed by the crimp joint terminal 20, the aluminum conductor portion 11A is mounted on the bottom portion 20*a* of the crimp joint terminal 20 so that the aluminum conductor portion 11A can be laid over at least a portion of the through hole 21. Accordingly, the aluminum conductor portions 11A can be easily laid over at least a portion of the through hole 21.

In the method according to the exemplary embodiment, the through hole 21 is formed in the bottom portion 20*a* of the crimp joint terminal 20, but the location of the through hole 21 is not limited thereto. For example, the through hole 21 may be formed in a different portion of the crimp joint terminal 20 such as a side portion of the crimp joint terminal 20.

While the crimp joint terminal 20 has a substantially U-shape in its cross section before crimping in the methods according to the exemplary embodiments described above, the configuration of the crimp joint terminal 20 is not limited thereto. The crimp joint terminal 20 may have a different shape as long as it can join conductor portions 11 of a plurality of insulated wires 10 by crimping. For example, the crimp joint terminal 20 may have a cylindrical configuration.

In the methods according to the exemplary embodiments described above, in the insulating coating intermediately-stripping step, the sections of the insulated wires 10 from which insulating coatings 12 are removed are adjusted to be substantially equal to each other in the direction in which the insulated wires 10 extend. However, the removal sections may differ among the insulated wires 10 as long as the conductor portions 11 of the insulated wires 10 exposed by intermediately-stripping the insulating coatings 12 can be joined.

Further, in the methods according to the exemplary embodiments described above, pressure and electric current are applied to the crimp joint terminal 20 for welding joint using the electrodes E. Alternatively, pressure and ultrasonic vibration may be applied to the crimp joint terminal 20 by using an ultrasonic horn or the like.

While the present invention has been described with reference to certain exemplary embodiments thereof, the scope of the present invention is not limited to the exemplary embodiments described above, and it will be understood by those skilled in the art that various changes and modifications may be made therein without departing from the scope of the present invention as defined by the appended claims.

What is claimed is:

1. A method for connecting a plurality of insulated wires to each other, each of the insulated wires having a conductor portion and an insulating coating covering the conductor portion, the insulating coating being made of an insulating material, the method comprising:

stripping the insulating coating of each of the insulated wires to expose the conductor portion such that the insulating coating is removed from a section of the insulated wire along a direction in which the insulated wire extends and at a location away from an end portion of the insulated wire; and connecting the conductor portions of the insulated wires, the connecting comprising crimping a crimp joint terminal onto the exposed conductor portions to join the exposed conductor portions, and after the crimping, welding the conductor portions by applying pressure and electric current or ultrasonic vibration to the crimp joint terminal, wherein the insulated wires comprises aluminum electric wires and copper electric wires, wherein the conductor portion of the aluminum electric wire is made of aluminum or aluminum alloy, and the conductor portion of the copper electric wire is made of copper or copper alloy, and wherein the connecting the conductor portions comprises laying the conductor portion of the aluminum electric wire over at least a portion of a through hole formed in the crimp joint terminal, the through-hole being configured to break an oxide film of the exposed conductor portion when the crimp joint terminal is crimped.

2. The method according to claim 1, wherein the stripping comprises adjusting the sections of the insulated wires, from which the insulated coatings are removed, to be substantially equal to each other in the direction in which the insulated wires extend, and wherein the connecting the conductor portions comprises aligning the sections of the insulated wires, from which the insulating coatings are removed, at both ends of the respective sections.

3. The method according to claim 1, wherein the through hole is formed in a portion of the crimp joint terminal forming a bottom portion of the crimp joint terminal after the crimping.

4. The method according to claim 1, wherein in the crimp join terminal a portion of the aluminum electric wires is arranged beneath a portion of the copper electric wires.

5. The method according to claim 1, wherein the connecting the conductor portions comprises laying, among the aluminum electric wires and the copper electric wires, the aluminum electric wire over the portion of the through hole.

* * * * *